US010760817B2

(12) United States Patent
Gohring et al.

(10) Patent No.: US 10,760,817 B2
(45) Date of Patent: Sep. 1, 2020

(54) LOUVER ASSEMBLY

(75) Inventors: Eric Gohring, Erlanger, KY (US); Michael Binkholder, Union, KY (US)

(73) Assignee: MESTEK, INC., Westfield, MA (US)

( * ) Notice: Subject to any disclaimer, the term of this patent is extended or adjusted under 35 U.S.C. 154(b) by 1448 days.

(21) Appl. No.: 12/580,367

(22) Filed: Oct. 16, 2009

(65) Prior Publication Data

US 2010/0099349 A1 Apr. 22, 2010

Related U.S. Application Data

(60) Provisional application No. 61/196,533, filed on Oct. 17, 2008.

(51) Int. Cl.
*F24F 13/08* (2006.01)
*E06B 7/08* (2006.01)
*F24F 13/18* (2006.01)

(52) U.S. Cl.
CPC ..... *F24F 13/18* (2013.01); *F24F 13/08* (2013.01)

(58) Field of Classification Search
CPC ..... F24F 13/08; F24F 13/18
USPC ..... 454/277, 279, 281, 282
See application file for complete search history.

(56) References Cited

U.S. PATENT DOCUMENTS 1,995,456 A * 3/1935 Kannel ..... F24F 13/08 454/224
2,123,287 A * 7/1938 Ney ..... F24F 13/08 454/216
3,056,343 A * 10/1962 Westerberg ..... E06B 7/082 454/279
D194,410 S * 1/1963 Bishop ..... D23/388
3,348,466 A * 10/1967 Lane ..... F24F 13/08 454/282
3,358,580 A * 12/1967 Freese ..... B01D 45/08 454/277
3,762,301 A * 10/1973 Gilbert ..... F24F 13/072 454/306
3,771,430 A * 11/1973 Lane ..... E06B 7/08 454/277
3,870,488 A * 3/1975 Arndt ..... B01D 45/08 55/440
3,953,183 A * 4/1976 Regehr ..... B01D 45/08 55/440
4,103,468 A * 8/1978 Olsen ..... F24F 13/08 454/277

(Continued)

*Primary Examiner* — Edelmira Bosques
*Assistant Examiner* — Phillip Decker
(74) *Attorney, Agent, or Firm* — Grogan, Tuccillo & Vanderleeden, LLP

(57) ABSTRACT

A louver assembly for placement in an opening for regulating the inlet of air, comprising a first blade stack and second blade stack arranged in tandem, and a sill for supporting the first and second blade stack. The first and second blade stacks have a plurality of blades arranged in a horizontally-spaced and vertically-extending configuration defining a plurality of horizontally-spaced and vertical extending air passageways for the passage of air therethrough. The sill has a generally planar first portion for supporting the first blade stack and a sloped second portion for supporting the second blade stack, wherein the sloped portion and the second blade stack define therebetween a void for equalizing pressure within the assembly to facilitate the draining of water therefrom.

16 Claims, 6 Drawing Sheets

(56) References Cited

U.S. PATENT DOCUMENTS 4,141,706 A * 2/1979 Regehr ..... B01D 45/16 55/437
4,145,032 A * 3/1979 Robertson ..... A01K 3/00 256/24
D272,181 S * 1/1984 Sixsmith ..... D23/413
4,430,101 A * 2/1984 Sixsmith ..... B01D 45/06 55/440
4,452,024 A * 6/1984 Sterriker ..... E06B 7/082 454/277
4,487,113 A * 12/1984 West ..... F24F 13/08 228/135
4,497,134 A * 2/1985 Meyer ..... E06B 9/04 454/224
4,581,051 A * 4/1986 Regehr ..... B01D 45/16 55/440
4,691,487 A * 9/1987 Kessler ..... E06B 7/14 137/527.8
4,901,387 A * 2/1990 Luke ..... A47C 27/146 5/727
4,958,555 A * 9/1990 Lentz ..... F24F 13/08 454/277
4,989,502 A * 2/1991 Ospelt ..... E06B 7/082 454/275
5,201,879 A * 4/1993 Steele ..... F24F 13/08 174/16.1
5,254,034 A * 10/1993 Roth ..... F24F 13/08 454/277
5,268,011 A * 12/1993 Wurz ..... B01D 45/08 55/294
5,297,373 A * 3/1994 Olsen ..... E06B 7/082 52/473
D373,625 S * 9/1996 Pereira ..... D23/355
5,737,874 A * 4/1998 Sipos ..... E06B 9/02 49/63
5,839,244 A * 11/1998 Johnson ..... F24F 13/08 52/473
5,906,083 A * 5/1999 Olsen ..... E06B 7/08 454/277
6,149,515 A * 11/2000 Van Becelaere ..... F24F 13/075 454/277
6,475,079 B1 * 11/2002 Basey ..... F24F 13/075 454/309
D591,843 S * 5/2009 Van Becelaere ..... D23/386
7,708,625 B2 * 5/2010 Leseman ..... B63J 2/04 454/10
9,393,510 B2 * 7/2016 MacDonald ..... B01D 50/002
2002/0026766 A1 * 3/2002 Wooster ..... E04B 2/58 52/741.1
2002/0056230 A1 * 5/2002 Horn ..... E06B 9/02 49/74.1
2005/0101243 A1 * 5/2005 Kennedy ..... E21F 17/103 454/169
2007/0275652 A1 * 11/2007 Berkompas ..... F21F 13/082 454/277
2010/0317281 A1 * 12/2010 Sperandio ..... E06B 7/082 454/224
2016/0216000 A1 * 7/2016 Monahan ..... F24F 13/15

* cited by examiner

LOUVER ASSEMBLY

CROSS REFERENCE TO RELATED APPLICATIONS

This application claims the benefit of U.S. Provisional Application Ser. No. 61/196,533, filed on Oct. 17, 2008, herein incorporated by reference in its entirety.

FIELD OF THE INVENTION

The present invention relates generally to a louver assembly that helps regulate the inlet of outside ambient air. More particularly, the invention relates to a storm louver assembly which substantially prevents air-born particulates (such as rain droplets) that are entrained in the ambient air, from passing therethrough and into the building or enclosure with which the louver assembly is associated.

BACKGROUND OF THE INVENTION

Ventilation/HVAC systems for buildings and other enclosures are well known in the art. A core component of many ventilation systems is the need to regulate the influx of outside ambient air. One aspect of this regulation is the desired ability to prevent particulate matter from entering the ventilation system along with the outside ambient air, and louver assemblies have therefore been traditionally utilized to help control the flow of ambient air and any entrained particulate matter.

Recent natural disasters and code modifications have placed larger burdens on the performance of louver assemblies that are integrated into various ventilation systems. In particular, recent code modifications have centered on reducing or eliminating the amount of rain water (i.e., water droplets) that are permitted to pass through the louver assembly and into the ventilation system as a whole.

On this issue, louvers that attempt to separate water and other particles from air flowing into buildings are generally known in the art. As exemplified by U.S. Pat. No. 5,839,244, hereby incorporated by reference, such prior art louvers typically include a plurality of curved, spaced blades that define a plurality of spaced, serpentine-shaped air passageways therebetween. The air passageways direct air from the exterior of the building to the interior of the building for air conditioning of the building.

When air passes into the building through the air passageways, the water particles in the air, which are heavier than the gas molecules in the air, cannot turn through the serpentine-shaped contours in the air passageways. The water molecules therefore strike the walls of the blades, agglomerate into drops and flow by gravity down the blades and out of the louvers.

However, buildings in areas of the world that are especially prone to hurricanes face much tougher problems with the design of louvers. In such hurricane zones, wind-driven rain may sometimes pass through the louver and into the building. In other situations, rain may accumulate at the bottom of a louver and be pushed through the louver and into the building by a constant and steady airflow. In addition, hurricanes and tornadoes often pick up debris which may be propelled by strong winds into the louver. Depending on the size and speed of the debris, such debris may damage the louver and cause the localized yielding of welds, compromising the integrity and functionality of the louver. Moreover, increased wind speed and thus increased airflow often leads to blade flutter or "chatter," which is undesirable. In hurricane zones, such as Miami-Dade County in the state of Florida, stringent building codes have recently been adopted which require louvers, dampers and the like to pass stringent tests for wind and wind-driven rain resistance. Additional building code provisions often require such louvers to pass missile impact, static load and cyclic load tests at varying speeds, pressures and cycles.

Unfortunately, known louvers are simply not designed to withstand missile impacts of the size and speed often generated by strong storms such as hurricanes and tornadoes. Moreover, known louver assemblies have a substantial amount of blade "chatter" when subject to high winds or large airflow volumes.

Therefore, in order to achieve a sufficient wind and wind-driven rain resistance, known louvers often employ a separate damper assembly behind the louver to block off water penetration. However, the closing of the damper to block off water penetration also blocks the flow of air into the building, which disqualifies such louver/damper systems from use in hurricane zones or other areas that frequently see high winds and large amounts of rain.

Known louvers capable of expelling water are generally of two types. The first type is a louver that employs separate gutters or down spouts or other drainage systems for carrying the removed water away from the louver and out of the building. This type of louver is undesirable because a separate drainage system must be installed to carry the water out of the building. The second type of louver utilizes drain holes to expel water. In these louvers, there is an orifice or nozzle pressure present at these drain holes as well as in between each blade. However, until enough water builds up to overcome the orifice pressure and drain via the drain holes, the water built up inside the louver is carried though the louver and into the building with the airflow. An example of this type of louver is shown by U.S. Pat. No. 5,839,244 (Paul A. Johnson et al.).

SUMMARY OF THE INVENTION

In view of the foregoing, it is an object of the present invention to provide a louver assembly capable of resisting the influx of wind-driven water without the use of a corresponding damper.

It is another object of the present invention to provide a louver assembly having an improved blade design.

It is another object of the present invention to provide a louver assembly having an improved blade design for absorbing a missile's inertial force and for allowing blade deformation without any localized yielding of welds.

It is another object of the present invention to provide a louver assembly having an improved blade design to eliminate chatter under airflow.

It is another object of the present invention to provide a louver assembly with an improved blade and sill design to facilitate the draining of water removed from the air away from the louver and out or away from the building.

It is another object of invention to provide louver assembly that is designed to meet the stringent criteria established by the Florida Building Code and Miami-Dade County Building Code, including providing high volume flow rate, impact resistance, protection against water penetration and high wind-loads.

The louver assembly of the present invention includes a plurality of stacks, positioned adjacent one another front to back. Each stack includes a plurality of elongated blades, each having opposed lower and upper edges and a support frame for supporting the blades in a horizontally-spaced and vertically extending configuration so that the blades define therebetween a plurality of horizontally-spaced and vertically extending air passageways for the passage of air into a building. The stacks are aligned so that the passageways of the first stack are aligned with the passageways of the second stack in the general direction of airflow so as to create uniform elongated air passageways. The preferred support frame includes a bottom frame member or sill for receiving and/or supporting the lower edges of the blades and a head frame member for receiving and supporting the upper edges of the blades.

The preferred blades each include a screw boss at the leading edge of each blade. This screw boss acts as a "crush" point during missile impact, absorbing some of the missile's inertial force as well as allowing blade deformation without any localized yielding of welds. The preferred blades also include thicker leading and trailing edges, strengthening the blades over long spans and thus eliminating blade chatter under airflow.

The preferred louver assembly also includes a sloped sill and square cut blades. This design creates a void under the back blade stack which acts to equalize the orifice pressure within the louver, allowing the water to easily drain, regardless of the pressures exerted at the face of the louver.

BRIEF DESCRIPTION OF THE DRAWINGS

The present invention will be better understood from reading the following description of non-limiting embodiments, with reference to the attached drawings, wherein below.

DETAILED DESCRIPTION OF THE PREFERRED EMBODIMENTS

Figure 1:
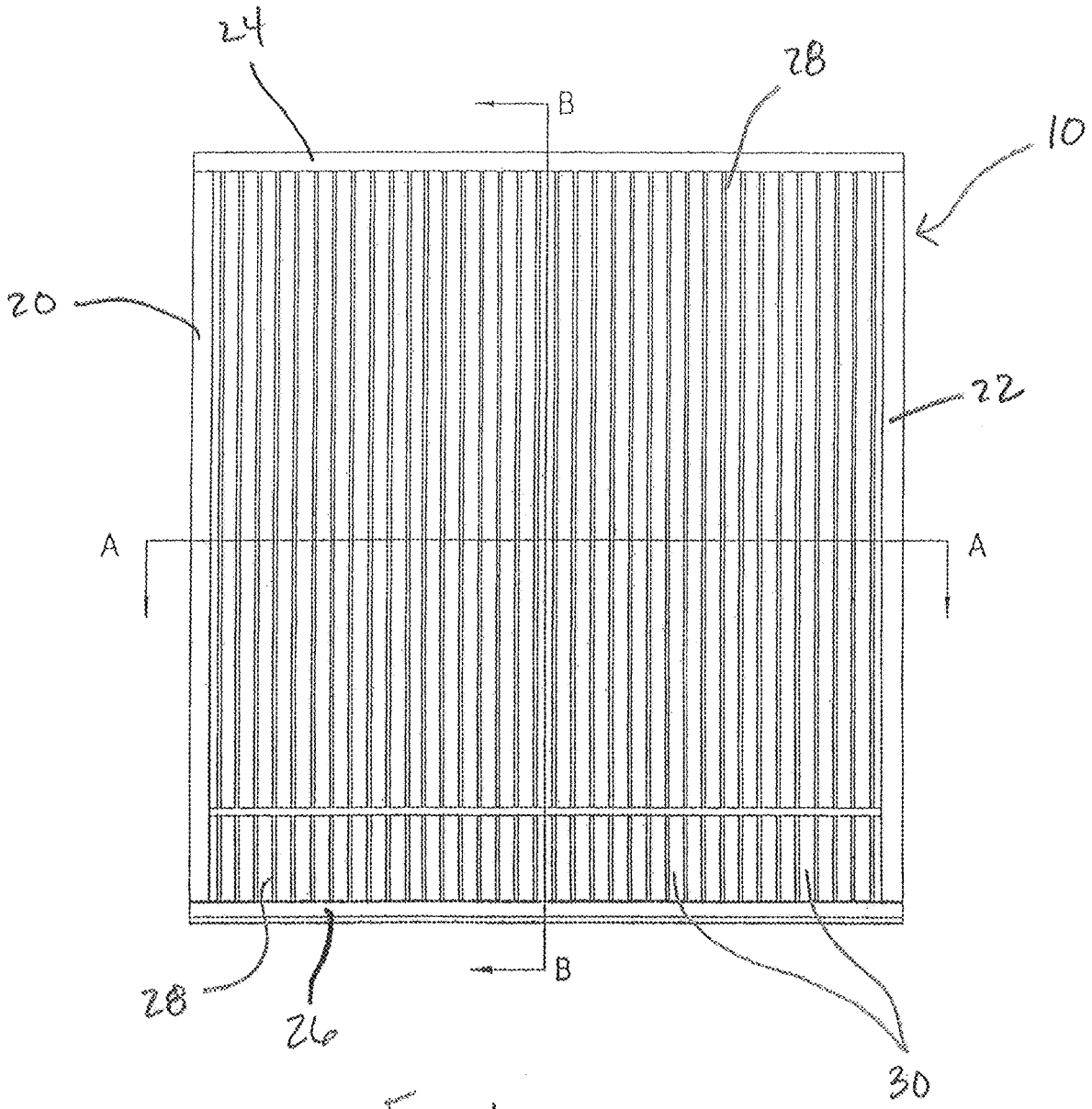
FIG. 1 is a simplified schematic front plan view of a louver assembly according to an embodiment of the present invention.
Figure 2:
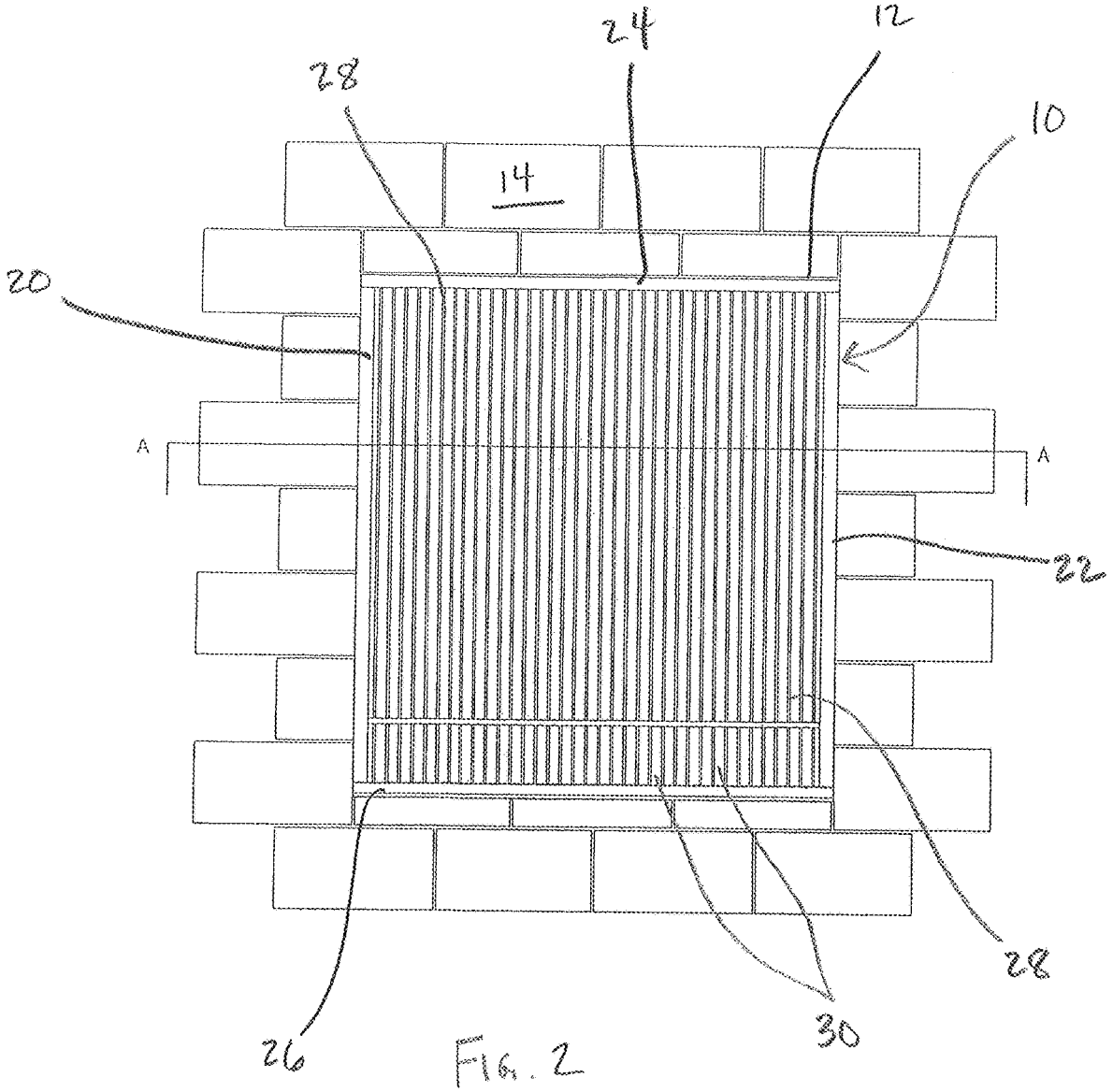
FIG. 2 is a simplified schematic front plan view of the lover assembly of FIG. 1 installed in an opening in a wall of a building according to an embodiment of the present invention.
Figure 3:
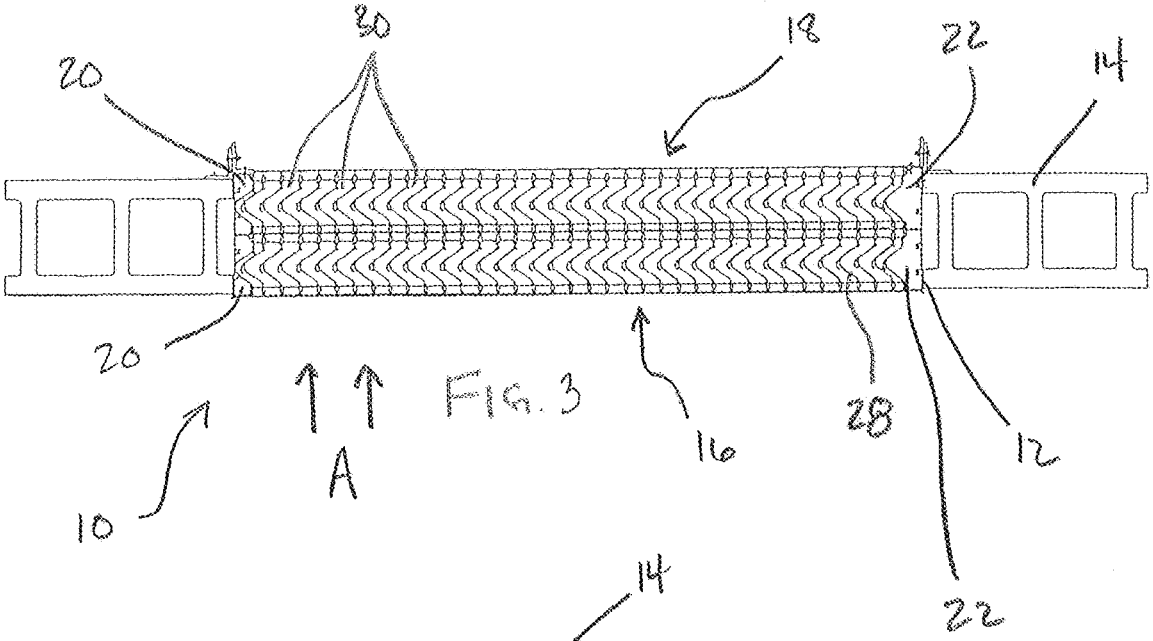
FIG. 3 is a sectional view of the louver assembly according to an embodiment of the present invention taken along line A-A of FIG. 2.
Figure 4:
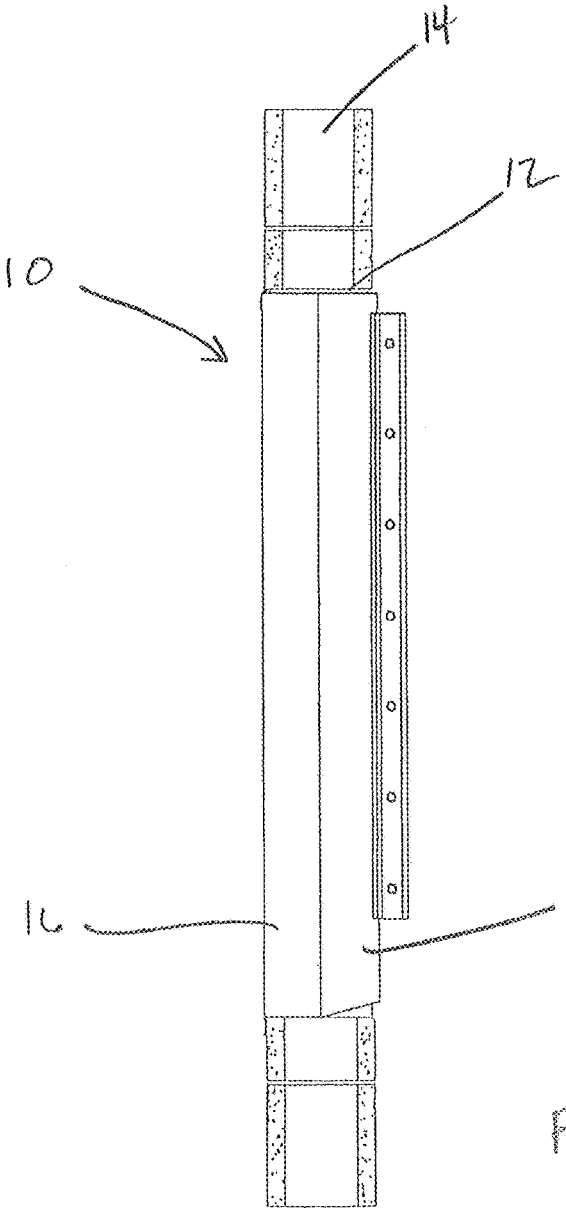
FIG. 4 is a simplified schematic side plan view of a louver assembly installed in an opening in a wall of a building according to an embodiment of the present invention.

One embodiment of a louver assembly of the present invention is indicated generally by reference numeral 10 in FIG. 1, and is designed to be inserted within an opening in a wall of a building to permit outside air to flow therethrough into the building while removing water particles from the air to prevent excess moisture from entering the building. FIGS. 2, 3 and 4 show such a louver assembly positioned within an opening 12 in a building 14.

While the louver assembly 10 is discussed as being disposed within an opening in a wall of a building or the like, it will be readily appreciated, however, that the louver assembly 10 may be integrated into any known ventilation system, including those systems having stand-alone components, without departing from the broader aspects of the present invention.

As best shown in FIGS. 3 and 4, the louver assembly comprises two vertical blade stacks, a first blade stack 16 and a second blade stack 18, arranged in tandem such that the first blade stack 16 faces outside the building in which it is installed and the second blade stack 18 is positioned directly behind the first blade stack.

With reference to FIGS. 1-3, each blade stack is bounded on the left side by a female jamb frame member 20 and on the right side by a male jamb frame member 22. The support frame for the louver assembly further includes a head frame member 24 which is wide enough to receive the upper edges of the blades in each blade stack, and a sill 26 which supports the bottom of each blade stack and facilitates the draining of water from the louver assembly, as described below. The head frame member 24 may extend the entire horizontal length of the opening, thus receiving the upper edge of each blade.

The male and female jamb members allow multiple louver assemblies to be joined together to span an opening of almost any dimension. In particular, when louvers are joined together or with additional louvers to span a wider opening, the end frame member on the right side of the left-most louver is replaced with a male-type jamb, and the end frame member on the left side of the right-most louver is replaced with a female-type end frame member.

As alluded to above, each blade stack 16, 18 of the louver assembly 10 includes a plurality of vertically extending blades 28 which, in the preferred embodiment, are uniformly spaced apart. The support frame, comprising the male and female jamb frame members 20, 22, the head frame member 24 and the sill 26, supports the blades 28 in a horizontally-spaced and vertically extending configuration such that the blades define therebetween a plurality of horizontally-spaced and vertically extending air passageways 30 for directing air from an exterior of the building to an interior of the building. The blade stacks 16, 18 are aligned so that the passageways of the first stack are aligned with the passageways of the second stack in the general direction of airflow so as to create uniform, elongated and serpentine shaped air passageways. (See FIG. 3).

Figure 5:
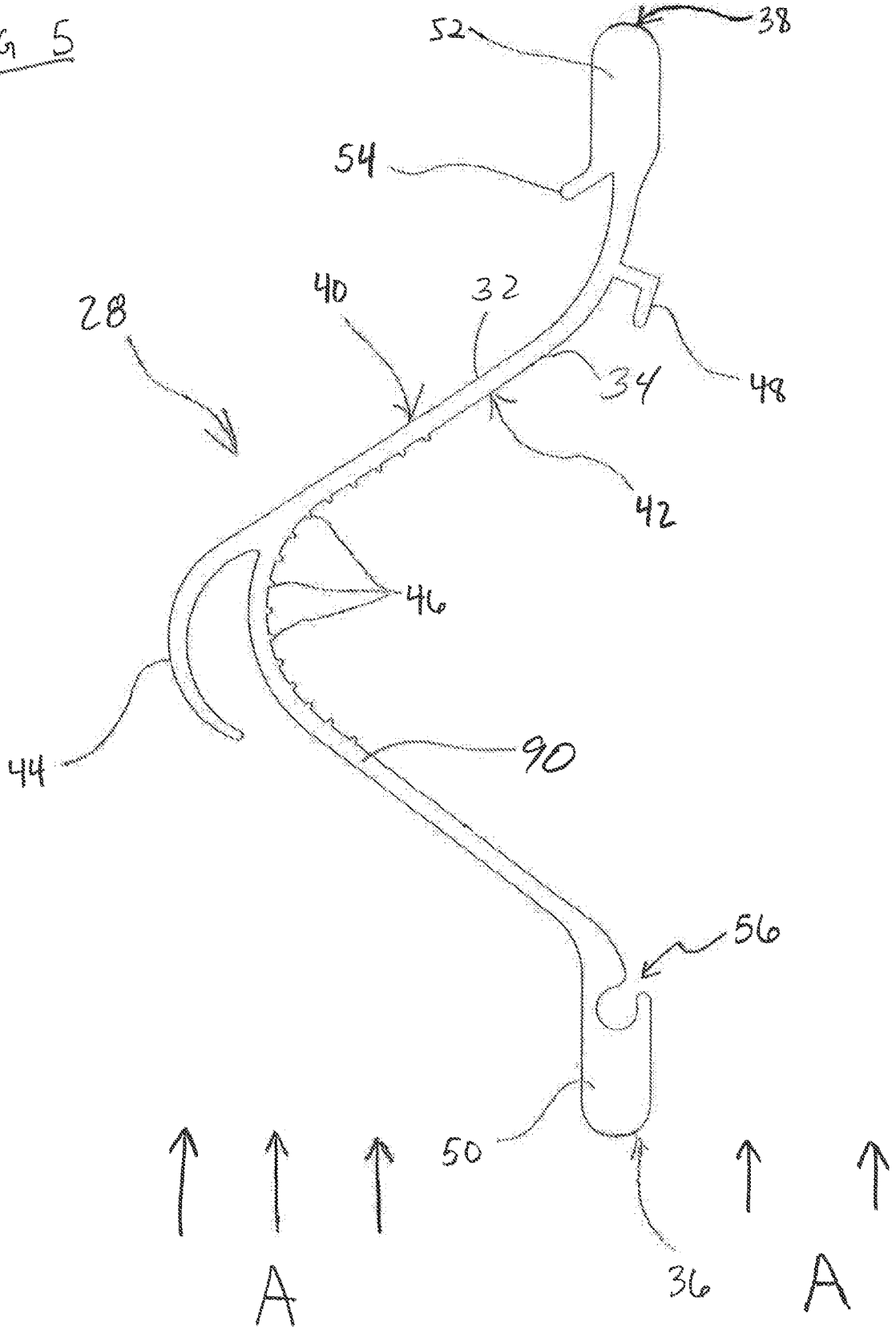
FIG. 5 is an enlarged top view of a blade of a louver assembly of FIGS. 1-4 according to an embodiment of the present invention.
Figure 6:
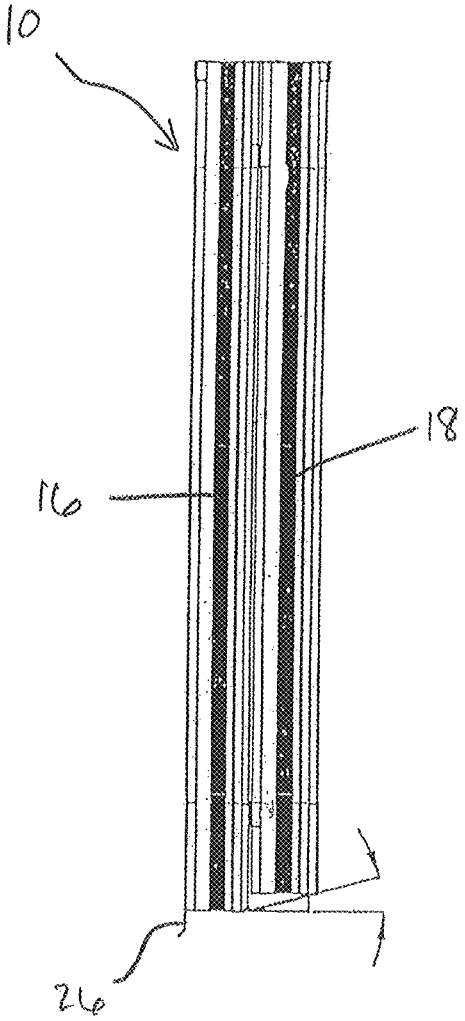
FIG. 6 is a sectional view of the louver assembly according to an embodiment of the present invention taken along line B-B of FIG. 1.
Figure 7:
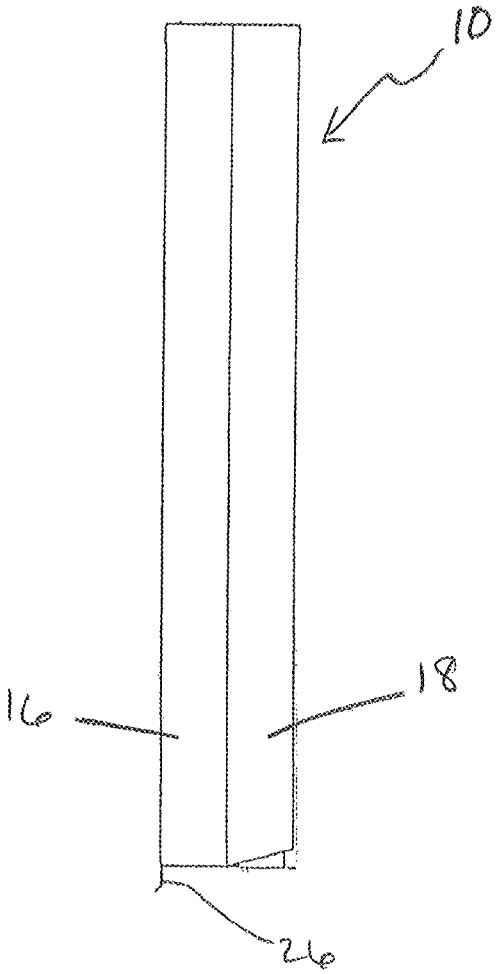
FIG. 7 is a simplified schematic side plan view of a louver assembly according to an embodiment of the present invention.

As shown in FIG. 5., the blade 28 includes a blade body 90. The blade body 90 extends between the front tab 50 and the rear tab 52, and extends between the opposed right and left vertically extending faces 40 and 42.

The blades 28 are positioned in the intermediate locations of the stacks 16, 18 between jamb members 20, 22. Each blade includes an arcuate hook 44 extending from its left face 40 in a direction generally towards the leading edge 36, and a plurality of horizontally-spaced projections 46 and an L-shaped tab 48 extending outwardly from its right face 42. Each blade 28 also includes a pair of enlarged tabs, a front tab 50 and a rear tab 52, at its leading and trailing edges 36, 38, respectively. The blades 28 also each include an angled tab 54 extending approximately from a point where the left face 40 meets the rear tab 54. These features cooperate to impede the flow of air-driven water particles through the louver assembly, as discussed below.

As further shown in FIG. 5, each blade 28 has a screw boss 56 formed in the front tab 50 adjacent the leading edge 36. The screw boss 56 is generally defined by a semi-circular cutout, void or channel in the front tab 50 which extends for the vertical height of the blade 28. The screw boss 56 acts as a "crush" point during missile impact, such as when debris may be throw at, or otherwise driven into, the louver assembly during high wind conditions. The screw boss 56 absorbs some of the missile's inertial force and allows for blade deformation without any localized yielding of welds. That is, the screw boss 56 allows for the leading and trailing edges 36, 38 to be manufactured thick enough to allow for the welding of the blades to the sill 26 while still allowing for blade deformation to absorb forces associated with missile impact. Moreover, as noted above, the blades 28 are configured with thicker front and rear tabs 50, 52, which act to strengthen the blade spans, thus eliminating blade "chatter" under airflow. In the preferred embodiment, the front and rear tabs 50, 52 are at least wider than the distance between the left face 40 and right face 42 (i.e., the width of the blade span) of the blades 26, and can even be twice or more times greater that the width of the blade span.

Figure 8:
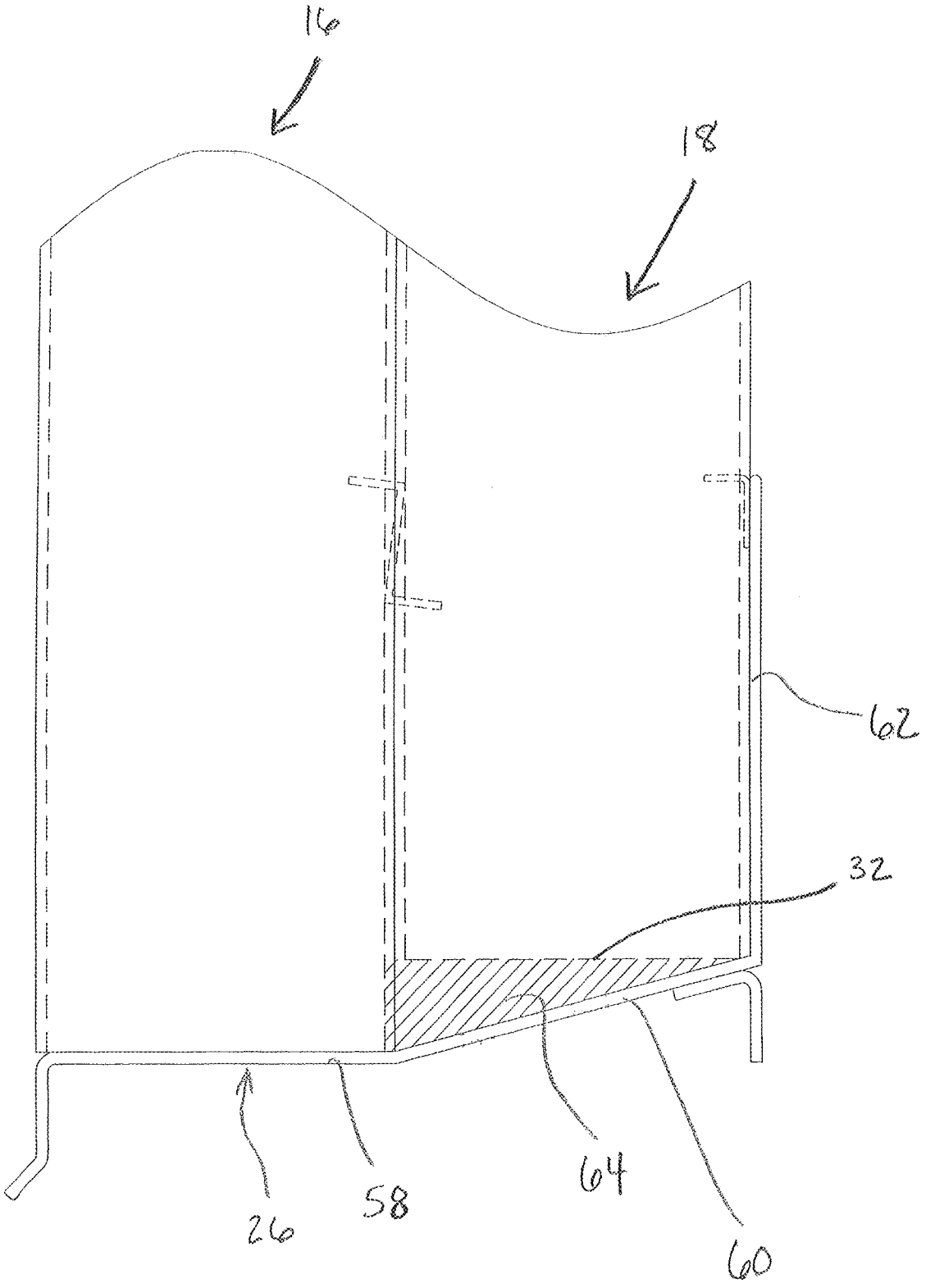
FIG. 8 is an enlarged partial side view of the louver assembly and sill according to an embodiment of the present invention.

Each blade stack, and the blades positioned therein, is supported by the sill 26. As best shown in FIG. 8, the sill comprises a generally planar first portion 58 for supporting the first blade stack 16, a sloped second portion 60 for accommodating and supporting the second blade stack 18, and a generally vertically extending backsplash portion 62 adjacent the sloped second portion 60 for further preventing water particles from passing through the louver assembly into the interior of the building. Preferably, the sloped portion 60 is at an angle of approximately 14 degrees from horizontal. Importantly, lower edges 32 of the blades 28 of the second blade stack 18 are square-cut, i.e. not mitered, such that the lower edges 32 of the blades 28 of the second stack 18 and the sloped portion 60 of the sill 26 define therebetween a void 64.

Returning now to FIGS. 3 and 5, in operation, air is directed into a building through the louver assembly 10 in the direction of arrows A. As the air traverses the passageways 30, the water particles in the air, which are heavier than the gas molecules in the air, cannot turn through the sine wave shaped contours. The water molecules therefore strike the walls of the blades 28 and are otherwise caught by the arcuate hook 44, projections 46, L-shaped tab 48 and angled tab 54 and removed from the air, thereby preventing the water molecules from passing through the assembly 10 and into the building. The water molecules that have been trapped by the blades 28 eventually agglomerate into drops and flow by gravity down the faces 40, 42 of the blades 28 to the sill 26 and out of the assembly, as hereinafter described.

Prior art louvers, such as that disclosed in U.S. Pat. No. 5,839,244, utilize drain holes to expel water that collects at the bottom of the louvers. With such louvers, there is an orifice or nozzle pressure at these drain holes as well as between each blade, so that until enough water builds up to overcome the orifice pressure and drain via the drain holes, water accumulates inside the louver and is carried through the louver with airflow and into the building.

With the present invention, however, the void 64 equalizes the pressure within the louver, allowing water to easily drain, regardless of pressures exerted at the face of the louver. Because the pressure within the louver assembly is equalized by the void 64, water particles that have been caught by the blades are permitted to flow onto the sill 26 and drain off the front of the sill 26 and out of the assembly 10. The sloped portion 60 of the sill 26 also aids in this draining by initiating a downhill stream of water, thereby pushing any water collected on the first planar portion 58 out of the assembly.

As will be readily appreciated, this blade/sill configuration does not allow rain, even wind-driven rain to penetrate the louver assembly and enter the building. Accordingly, no damper is needed to ensure that water does not pass through the louver, even in high wind or hurricane conditions. As such, the louver assembly of the present invention may be used to regulate the influx of outside ambient air even in storm conditions.

The components of each support frame described above are preferably formed from aluminum, but may also be formed of other suitable materials. When assembled, each blade stack 16, 18 is preferably 48" wide by 48" high, and 4" deep. As assembled, the entire louver assembly 10 and its support frame is approximately 48" wide by 48" high, and 8" deep, although multiple assemblies may be joined together as described above to span openings of greater dimension. In the preferred embodiment, the blades of each stack are uniformly spaced apart at a distance of approximately 1¼", measured from the center of one blade tab to the center of the next adjacent blade tab. In addition, each blade 28 takes up approximately 1.705" in width, measured from edge to edge, i.e., a point of tangential contact on the arcuate hook (left most edge) to a line drawn through the opposing edges of the tabs 50, 52 (right most edge).

In the preferred embodiment, the sill 26 is approximately 8.3" deep and 7.5" tall, and may include an angle (not shown) or other supporting structure beneath the backsplash portion 62 for supporting the rear-most portion of the sill 26.

Mounting of the louver assembly inside an opening in a building can be done by various techniques known in the art. As shown in FIGS. 3, 4 and 8, such mounting can be accomplished via the use of complimentary brackets and screws secured to the louver frame and to the building.

Although this invention has been shown and described with respect to the detailed embodiments thereof, it will be understood by those of skill in the art that various changes may be made and equivalents may be substituted for elements thereof without departing from the scope of the invention. In addition, modifications may be made to adapt a particular situation or material to the teachings of the invention without departing from the essential scope thereof. Therefore, it is intended that the invention not be limited to the particular embodiments disclosed in the above detailed description, but that the invention will include all embodiments falling within the scope of this disclosure.

What is claimed is:

1. A blade comprising:

a lower edge;

an upper edge;

a leading edge;

a tailing edge;

a front tab;

a rear tab;

a blade body;

a first vertically extending face;

a second vertically extending face;

an arcuate hook;

an angled tab; and, an L shaped tab;

wherein the leading edge is configured to face a first direction and the trailing edge is oriented facing an opposite second direction;

wherein the leading edge is configured to define an edge of the front tab and the trailing edge is configured to define an edge of the rear tab;

wherein a surface of the front tab opposite the leading edge changes from a first thickness to a second thickness defining a first transition zone from the front tab to the blade body;

wherein the blade body maintains said second thickness from the front tab until it transitions back to the first thickness defining a second transition zone at a point on the rear tab opposite the trailing edge;

wherein between the first and second transition zones the blade body is curved with an apex in the direction of the first vertically extending face;

wherein the arcuate hook extends from the first vertical surface of the blade body starting from the side of the apex proximate to the tailing edge, extending over the apex with the hook opening facing first direction;

wherein the second transition zone has the angled tab located on the first vertical surface; and, wherein the second vertically extending face has the L-shaped tab positioned proximate to the rear tab.

2. The blade of claim 1 further comprising: a screw boss;

wherein the screw boss is positioned in the second vertically extending face of the front tab distal to the leading edge and prior to the first transition zone, the screw boss further having a diameter less than the first thickness and greater than the second thickness.

3. The blade of claim 1 further comprising: wherein the first thickness is configured in greater proportion to the second thickness such that blade chatter is eliminated.

4. The blade of claim 3 further comprising: wherein the first thickness is at least twice as large as the second thickness.

5. The blade of claim 1 further comprising: a plurality of horizontally spaced projections; wherein the plurality of horizontally spaced projections are located at the apex of the blade body on the second vertically extending face.

6. The blade of claim 1 further comprising: wherein the leading edge and trailing edge of the front and rear tabs are configured into an identical shape.

7. A louver assembly comprising:

at least one blade;

a first jamb member;

a second jamb member;

a head frame member; and, a sill;

wherein the head frame member is configured to receive an upper edge of at least one blade;

wherein the sill is configured to receive at least one lower edge of at least one blade;

wherein the at least one blade is a plurality of blades configured to form a first stack and a second stack;

wherein the sill is configured with a planar first portion and a sloped second portion extending from the planar first portion to a backsplash portion; and, wherein first bottom edges of the plurality of blades forming the first stack are received upon the planar first portion of the sill and wherein second bottom edges of the blades forming the second stack remain square cut in profile and are received and supported at an intersection of the sloped second portion and the backsplash portion.

8. The louver assembly of claim 7 further comprising:

wherein the bottom edge of the blades forming the second stack and the sloped portion of the sill define a void configured to equalize pressure within an interior of the louver assembly with pressure exterior to the louver assembly.

9. The louver assembly of claim 7 further comprising:

wherein first passageways formed between the plurality of blades forming the first stack are configured to be continuous with second passageways formed between the plurality of blades forming the second stack.

10. The louver assembly of claim 7 further comprising:

wherein a leading edge of the plurality of blades forming the first and second stacks, and, the planar first portion of the sill are oriented towards a flow of water and air moving externally from the louver assembly into and through the louver assembly.

11. The louver assembly of claim 7 further comprising:

wherein in a leading edges of the plurality of blades comprising the first stack define an opening to an HVAC system.

12. The louver assembly of claim 7 further comprising:

wherein the upper and lower edges of the plurality of blades forming the first stack are welded at front and rear tabs of the plurality of blades, to the head frame member and the planar portion of the sill.

13. The louver assembly of claim 7 further comprising:

wherein the upper upper edges of the plurality of blades forming the second stack are welded to the head frame member at a front and rear tabs of the plurality of blades, and the lower edge is welded to the intersection of the sloped second portion of the sill and the backsplash portion at the rear tabs.

14. The louver assembly of claim 7 further comprising:

wherein the assembly is installed as part of an air intake in a building.

15. The louver assembly of claim 7 further comprising:

wherein the first jamb member is a male jamb member and the second jamb member is a female jamb member; and, wherein when a male jamb member of a first louver assembly is combined with a female jamb member of a second louver assembly the first and second louver assemblies are integrated into a larger louver assembly.

16. A louver assembly for placement in an opening of a structure to regulate a passage of air and water therethrough, comprising:

a first blade assembly including a plurality of vertically aligned louver blades;

a second blade assembly including a plurality of vertically aligned louver blades;

a frame assembly encompassing said first and said second blade assemblies, said frame assembly including a sill having a planar portion and an angled portion, said angled portion being coextensive with said planar portion and oriented at a predetermined angle with respect to said planar portion;

wherein said plurality of vertically aligned blades of said first blade assembly rest upon said planar portion of said sill; and wherein said plurality of vertically aligned blades of said second blade assembly extend outwardly from said angled portion forming thereby an open void behind said first blade assembly and below said second blade assembly.

* * * * *